US010414012B2

(12) United States Patent
Tchakarov

(10) Patent No.: US 10,414,012 B2
(45) **Date of Patent: *Sep. 17, 2019**

(54) GRINDING PAD APPARATUS

(71) Applicant: Husgvarna Construction Products North America, Inc., Charlotte, NC (US)

(72) Inventor: Tchavdar V. Tchakarov, Monroe, MI (US)

(73) Assignee: Husqvarna Construction Products North America, Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/405,361

(22) Filed: Jan. 13, 2017

(65) Prior Publication Data

US 2018/0200857 A1 Jul. 19, 2018

(51) Int. Cl.
*B24B 41/047* (2006.01)
*B24B 7/18* (2006.01)
(Continued)

(52) U.S. Cl.
CPC ..... *B24B 7/186* (2013.01); *B24B 7/18* (2013.01); *B24B 7/22* (2013.01); *B24B 41/047* (2013.01);
(Continued)

(58) Field of Classification Search
CPC .. B24B 7/18; B24B 7/186; B24B 7/22; B24B 41/047; B24D 7/06; B24D 7/08; B24D 13/14
(Continued)

(56) References Cited

U.S. PATENT DOCUMENTS 2,225,193 A 12/1940 Benner et al.
2,425,368 A * 8/1947 Doermann ..... B24D 7/16 451/548
(Continued)

FOREIGN PATENT DOCUMENTS

CA 159666 7/2015
CA 162792 7/2015
(Continued)

OTHER PUBLICATIONS

"Diamond Tools for Construction Stone," EHWA Diamond Ind. Co. Ltd. Catalogue, Published 2016, 60 pages.
(Continued)

*Primary Examiner* — Eileen P Morgan
(74) *Attorney, Agent, or Firm* — Harness, Dickey & Pierce, PLC

(57) ABSTRACT

A workpiece abrading pad apparatus is provided. In one aspect, a grinding pad apparatus employs a flexible pad, a flexible metallic reinforcement layer or ring, and multiple floor-grinding disks. In another aspect, a metallic reinforcement ring includes a central hole through which a fiber or foam pad is accessible. Another aspect employs a spring steel reinforcement ring to which multiple diamond-based abrasive disks or dots are attached. In yet another aspect, at least one floor-contacting disk attached to a reinforcement ring includes sintered powdered metal with diamond particles mixed therein. A further aspect employs abrasive, floor-contacting disks or dots including posts extending from backsides thereof for attachment to a reinforcing ring or layer.

21 Claims, 6 Drawing Sheets

(51) Int. Cl.

| | |
|---|---|
| ***B24B 7/22*** | (2006.01) |
| ***B24D 7/06*** | (2006.01) |
| ***B24D 7/08*** | (2006.01) |
| ***B24D 13/14*** | (2006.01) |

(52) U.S. Cl.
CPC ..... *B24D 7/06* (2013.01); *B24D 7/08* (2013.01); *B24D 13/14* (2013.01)

(58) Field of Classification Search
USPC ..... 451/353, 548
See application file for complete search history.

(56) References Cited

U.S. PATENT DOCUMENTS 3,121,982 A * 2/1964 Miller ..... B24D 7/06 451/548
3,464,166 A * 9/1969 Bouvier ..... B24D 13/14 451/548
3,517,466 A * 6/1970 Bouvier ..... B24D 13/14 451/490
3,823,516 A 7/1974 Christian
3,934,377 A 1/1976 Tertinek
4,271,557 A 6/1981 Caron
4,502,174 A 3/1985 Rones
4,724,567 A 2/1988 Rones
5,054,245 A 10/1991 Coty
5,076,023 A * 12/1991 Saguchi ..... B24D 7/066 451/540
5,170,595 A 12/1992 Wiand
5,174,795 A 12/1992 Wiand
5,247,765 A * 9/1993 Quintana ..... B24D 7/063 451/548
D367,743 S 3/1996 Krause et al.
5,567,503 A * 10/1996 Sexton ..... B24B 7/22 428/137
5,586,930 A * 12/1996 Hayashi ..... B24B 7/22 451/548
5,605,493 A 2/1997 Donatelli et al.
5,607,345 A 3/1997 Barry et al.
5,683,143 A 11/1997 Peterson et al.
5,782,682 A 7/1998 Han et al.
5,970,559 A 10/1999 Christy
6,196,911 B1 * 3/2001 Preston ..... B24D 18/00 451/548
6,234,886 B1 * 5/2001 Rivard ..... A47L 11/164 451/353
6,261,164 B1 * 7/2001 Rivard ..... A47L 11/164 451/353
6,371,842 B1 4/2002 Romero
6,739,963 B1 5/2004 Mas Garcia
D510,850 S 10/2005 Boler, Jr.
7,033,258 B2 4/2006 Jordan
7,059,801 B2 6/2006 Snyder et al.
7,104,739 B2 * 9/2006 Lagler ..... B27C 1/005 299/41.1
7,147,548 B1 * 12/2006 Mehrabi ..... B24B 7/186 451/323
7,192,339 B1 * 3/2007 Harding ..... B24B 7/186 451/350
7,204,745 B2 4/2007 Thysell
7,223,161 B2 5/2007 Kodani et al.
D559,063 S 1/2008 Okamoto et al.
D576,855 S 9/2008 Okamoto et al.
D581,237 S 11/2008 Okamoto et al.
D584,591 S 1/2009 Tano et al.
7,506,644 B2 3/2009 Park
D592,029 S 5/2009 Tano et al.
D592,030 S 5/2009 Tano et al.
D600,989 S 9/2009 Tano et al.
D612,874 S * 3/2010 Nilsson ..... D15/138
7,670,208 B2 * 3/2010 Thysell ..... B24B 7/186 125/3
7,690,970 B2 4/2010 Palushaj
7,713,109 B2 5/2010 Estes
7,744,447 B2 * 6/2010 Kodani ..... B24D 7/06 451/259
7,815,393 B2 10/2010 Snyder et al.
7,997,960 B2 8/2011 Williams, Sr.
8,147,297 B2 * 4/2012 Hamm ..... B24B 41/047 451/270
8,176,909 B2 5/2012 Ilgner
8,192,255 B2 6/2012 Gallup et al.
8,251,780 B2 8/2012 Ward et al.
8,272,924 B2 9/2012 Van Eijden et al.
D678,745 S 3/2013 Nguyen
8,464,420 B2 * 6/2013 Ye ..... B24B 7/186 29/244
D694,081 S 11/2013 Wright
8,790,164 B2 7/2014 Rivard et al.
D731,448 S 6/2015 Kinoshita et al.
D732,917 S 6/2015 Valentini
D743,456 S * 11/2015 Shinozaki ..... D15/126
9,174,326 B2 11/2015 Ahonen
9,314,899 B2 4/2016 Puchegger et al.
9,925,645 B2 * 3/2018 Song ..... B24D 7/066
2005/0164620 A1 * 7/2005 Amamoto ..... B23C 5/006 451/548
2005/0172428 A1 8/2005 Thysell
2005/0227600 A1 10/2005 Fisher
2006/0025059 A1 2/2006 Gueorguiev et al.
2007/0254568 A1 * 11/2007 Park ..... B24D 7/066 451/548
2007/0292207 A1 * 12/2007 Reed ..... B24B 7/186 404/112
2008/0108286 A1 5/2008 Thysell et al.
2008/0176498 A1 7/2008 Rossi et al.
2008/0311826 A1 12/2008 Thysell
2009/0190999 A1 7/2009 Copoulos
2009/0191799 A1 * 7/2009 Rivard ..... B24D 9/085 451/259
2010/0136889 A1 6/2010 Kilgren et al.
2011/0223845 A1 * 9/2011 Van Der Veen ..... B24B 7/186 451/548
2011/0300784 A1 * 12/2011 Tchakarov ..... B24B 7/186 451/259
2012/0270483 A1 * 10/2012 Bae ..... B24B 7/186 451/540
2013/0225051 A1 * 8/2013 Vankouwenberg .... B24D 11/02 451/350
2013/0324021 A1 * 12/2013 Ryan ..... B24D 11/00 451/529
2016/0083967 A1 3/2016 Tchakarov et al.
2016/0136772 A1 5/2016 Littlefield et al.
2016/0221155 A1 8/2016 Song et al.
2017/0129067 A1 5/2017 Young
2018/0206690 A1 * 7/2018 Tchakarov ..... B24D 13/14

FOREIGN PATENT DOCUMENTS

| | | |
|---|---|---|
| CA | 162793 | 7/2015 |
| CA | 162794 | 7/2015 |
| CA | 162795 | 7/2015 |
| CA | 162796 | 7/2015 |
| CA | 162797 | 7/2015 |
| DE | 20120137 U1 | 2/2002 |
| DE | 102009008261 A1 | 8/2010 |
| DE | 202015101442 U1 | 5/2015 |
| JP | S56-94267 U | 7/1981 |
| JP | H01117854 U | 8/1989 |
| JP | 2004025401 A | 1/2004 |
| JP | 2004276197 A | 10/2004 |
| JP | 2006-068885 A | 3/2006 |
| JP | 2012232378 A | 11/2012 |
| KR | 100816026 B1 | 3/2008 |
| KR | 100853547 B1 | 8/2008 |

OTHER PUBLICATIONS

Office Action dated Nov. 2, 2018 in related Canadian Application No. 2,991,376.

(56) References Cited

OTHER PUBLICATIONS

Diamond Tool Supply, Inc., "Floor Maintenance and Cleaning—Vortex" Catalog, (published on or before May 2013).
Diamond Tool Supply, Inc., "Tools for Concrete" Catalog, (published on or before May 2013).
Diamond Tool Supply, Inc., "Floor Maintenance and Cleaning—Monroe" Catalog, (published prior to Sep. 2014).
Diamond Tool Supply, Inc., "Tools for Stone" Catalog, (published prior to Sep. 2014).
Diamond Tool Supply, Inc., "Tools for Concrete" Catalog, (published prior to Sep. 2014).
HTC, "Professional Floor Systems" Product catalog 2014, www.htc-floorsystems.com, 2014.
HTC, "Professional Floor Systems" Product catalogue 2015, www.htc-floorsystems.com, 2015.
Wagman Metal Products Inc., "Concrete Finishing Tools" Catalog, (published prior to Sep. 23, 2016).

* cited by examiner

GRINDING PAD APPARATUS

BACKGROUND AND SUMMARY

The disclosure relates generally to a pad assembly and more particularly to a floor grinding pad apparatus.

It is known to use fibrous pads for polishing and grinding floors within industrial or commercial buildings. Such polishing or grinding pads are ideally suited for use on concrete, terrazzo, and natural (e.g., marble), engineered and composite stone floors. Examples of such pads and the powered machines used to rotate such can be found in the following U.S. patents and patent publication numbers: 2011/0300784 entitled "Flexible and Interchangeable Multi-Head Floor Polishing Disk Assembly" which was invented by Tchakarov et al. and published on Dec. 8, 2011; U.S. Pat. No. 9,174,326 entitled "Arrangement For Floor Grinding" which issued to Ahonen on Nov. 3, 2015; U.S. Pat. No. 6,234,886 entitled "Multiple Abrasive Assembly and Method" which issued to Rivard et al. on May 22, 2001; U.S. Pat. No. 5,605,493 entitled "Stone Polishing Apparatus and Method" which issued to Donatelli et al. on Feb. 25, 1997; and U.S. Pat. No. 5,054,245 entitled "Combination of Cleaning Pads, Cleaning Pad Mounting Members and a Base Member for a Rotary Cleaning Machine" which issued to Coty on Oct. 8, 1991. All of these patents and the patent publication are incorporated by reference herein.

Notwithstanding, improved floor grinding performance is desired. Furthermore, some of these prior constructions exhibit uneven wear in use which prematurely destroy the pads or cause inconsistent polishing or grinding. Moreover, floor unevenness and cracks may create only partial contact with abrasive grinding members, thereby adding extra grinding time and causing uneven grinding with some prior rigid devices.

In accordance with the present invention, a workpiece abrading pad apparatus is provided. In one aspect, a grinding pad apparatus employs a flexible pad, a flexible metallic reinforcement layer or ring, and multiple floor-grinding disks. In another aspect, a metallic reinforcement ring includes a central hole through which a fiber or foam pad is accessible. Another aspect employs a spring steel reinforcement ring to which multiple diamond-based abrasive disks or dots are attached. In yet another aspect, at least one floor-contacting disk attached to a reinforcement ring includes sintered powdered metal with diamond particles mixed therein. A further aspect employs abrasive, floor-contacting disks or dots including posts or mechanical fasteners extending from backsides thereof for attachment to a reinforcing ring or layer. A method of making a grinding pad apparatus is also presented.

The present pad assembly is advantageous over traditional devices. For example, the flexible metallic reinforcement layer or ring of the present pad apparatus advantageously allows greater and more even floor contact over worn areas and cracks due to disk-to-disk flexibility, which is expected to improve grinding performance. Furthermore, the disk post and method of manufacturing the apparatus advantageously provide a more secure attachment of components. The flexible metallic reinforcement ring, in combination with sintered powdered metal and diamond disks, provide enhanced durability during the grinding operation which is a much harsher, jarring and vibration-prone operating condition than for polishing or honing. Additional advantages and features of the present invention will be readily understood from the following description, claims and appended drawings.

DETAILED DESCRIPTION

Figure 1:
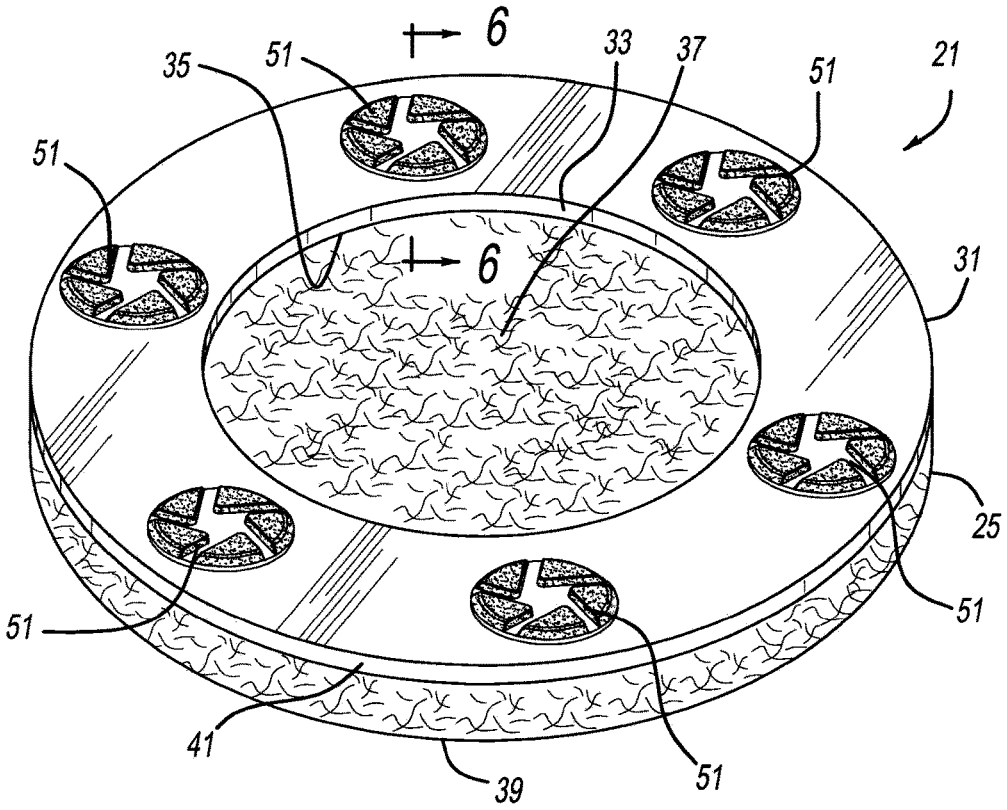
FIG. 1 is a bottom perspective view showing a grinding pad apparatus.
Figure 2:
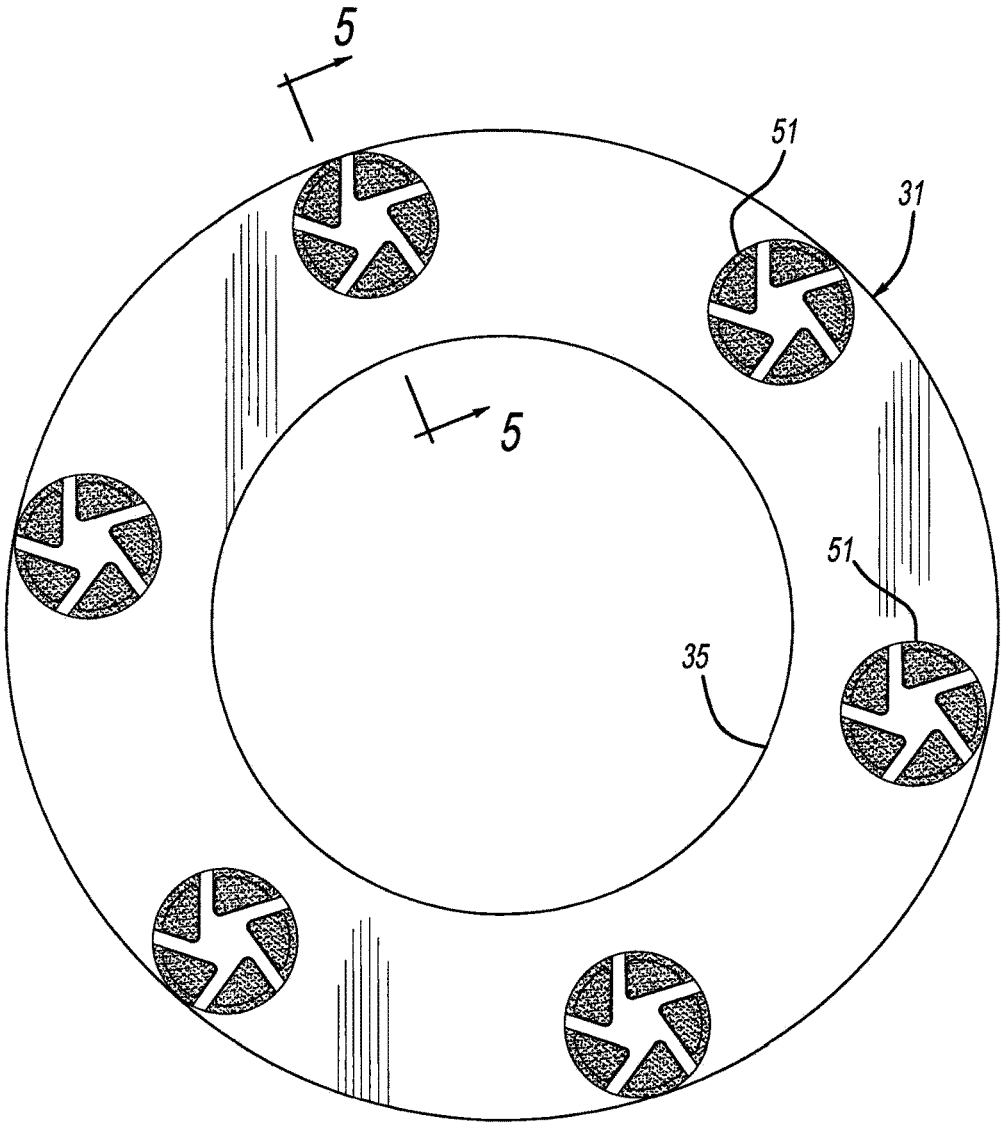
FIG. 2 is a bottom elevational view showing a reinforcement ring and abrasive disks employed with the grinding pad apparatus.
Figure 3:
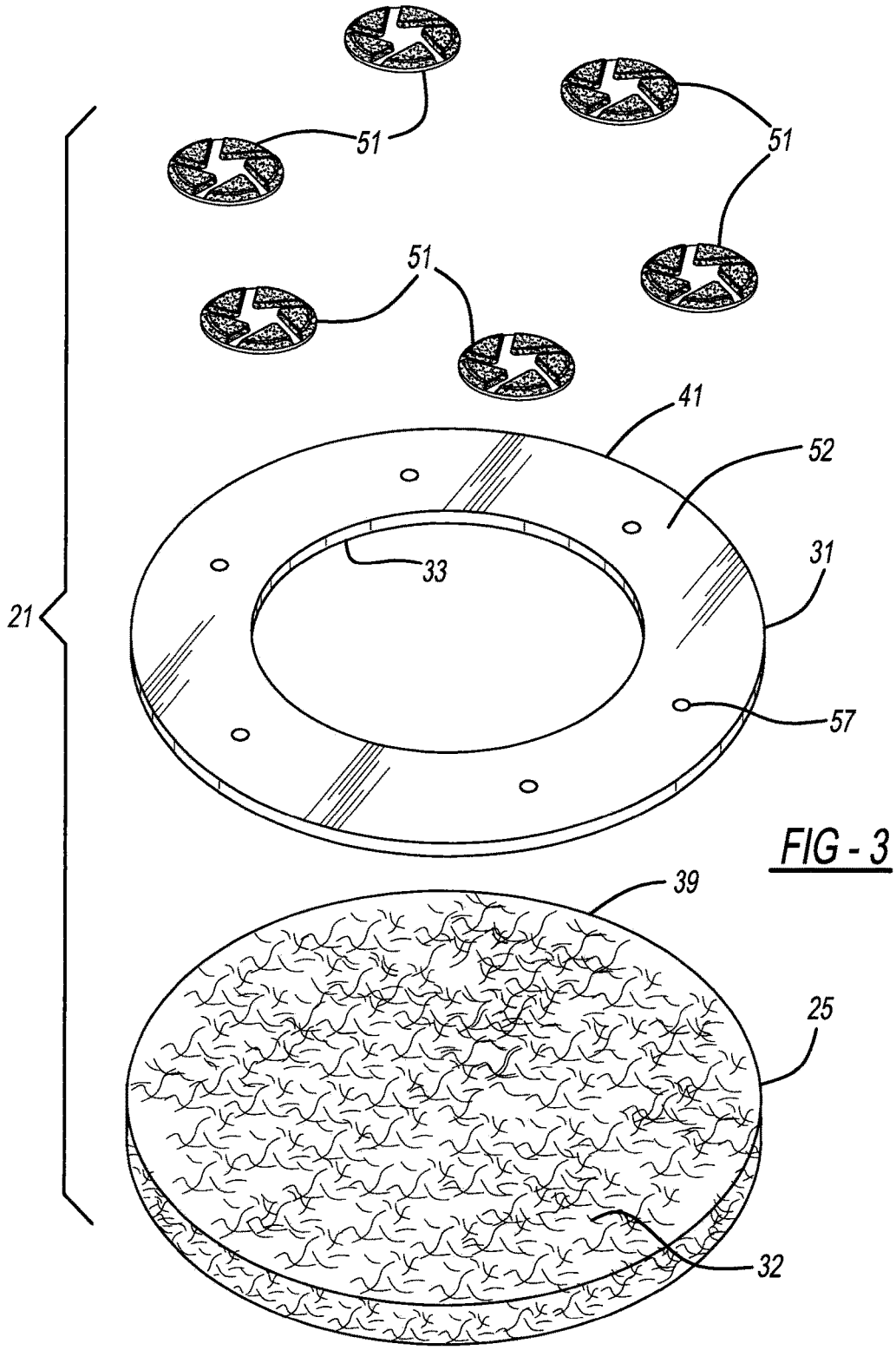
FIG. 3 is an exploded bottom perspective view showing the grinding pad apparatus.

A preferred embodiment of a grinding pad apparatus 21 is shown in FIGS. 1-6. Pad apparatus 21 is used for grinding composite surfaces, such as concrete, stone or terrazzo floors 23. Grinding pad apparatus 21 includes a base pad 25, which is a flexible and deformable material, including natural and/or artificial fibers mixed with a polymeric resin. However, to save expense, base pad 25 preferably does not employ any diamond particles. Base pad 25 has a generally circular periphery, with a diameter of at least 7 inches, more preferably 7-27 inches, and most preferably 14 inches, and a thickness of at least 0.25 inches and more preferably 0.5-2.0 inches. Of course, base pad 25 could be made in other sizes.

A reinforcement ring or layer 31 is secured to a bottom face or surface 32 of base pad 25, by a contact cement type of adhesive. Reinforcement ring 31 is generally annular having a central opening 33 with an inner diameter of approximately 9.5 inches and an outer diameter of approximately 14 inches for one version of the pad apparatus. Reinforcement ring 31 has a thickness greater than zero and up to 0.0304 inch (1 mm), and more preferably 0.0197 inch (0.5 mm). Reinforcement ring or layer 31 is metallic and more preferably a high carbon 1095, hardened and tempered spring steel material. Reinforcement ring 31 reinforces and adds some radial stiffness and toughness to the outer portion of pad 25 to resist rotational centrifugal forces when grinding, however, ring 31 advantageously allows a significant amount of torsional and longitudinal flexibility and resilience to pad apparatus 21 so it can flex with and follow any floor imperfections thereby producing uniform disk-to-disk floor contact for grinding. This is especially beneficial when worn areas of the floor or cracks in the floor are otherwise encountered by only some disks but not others. Without the present flexible ring, conventional more rigid pad assemblies may not remove enough floor material during the very abrasive grinding operation, which is not as important for the finer grit polishing or honing operations, by way of comparison.

A circular internal edge 33 of reinforcement ring 31 defines a central opening or hole 35 which exposes a central surface 37 of base pad 25. This large diameter internal edge 33 allows for easier torsional flexure of the ring during use. Base pad 25 and ring 31 preferably have concentrically aligned circular peripheral surfaces 39 and 41, respectively.

A plurality of abrasive tools such as floor-contacting disks or dots 51 are secured to a bottom surface 52 of reinforcement ring 31. In the example shown, disks 51 are made of a sintered powdered metal composition of bronze, copper and iron, to which is added diamond particles. The diamond particles are very course for grinding, preferably having a grit size of 100 or less, and more preferably 24-50. Each disk includes a generally circular body 54 with an exemplary outer peripheral diameter of 2.123 inches (54 mm), a total height below reinforcement ring 31 of 0.00787 inch (5.0 mm) and a depth of groove 53 of 0.0131 inch (3.0 mm).

An optional and cylindrically shaped post 55 projects from a backside of each disk body 54 in a longitudinal direction substantially parallel to a rotational axis of the pad apparatus, and is intergrally formed therewith as a single piece. Post 55 is approximately 0.394 inch (10.0 mm) wide and approximately 0.0591 inch (1.5 mm) long. Furthermore, post 55 projects through an aperture 57 pierced in ring 31. Multiple of the apertures are equally spaced apart in the ring. A distal end of post 55 is deformed to outwardly expand like a mushroom head thereby creating an enlarged head 59 which is laterally larger than aperture 57. Thus, ring 31 is sandwiched and compressed between head 59 and the backside of each disk 51 to mechanically attach and secure disks 51 to ring 31. Adhesive may additionally or instead be employed to attach and secure disks 51 to ring 31 with or without the posts, depending on the specific durability requirement and coarseness of the grit for grinding.

It is alternately envisioned that multiple parallel and spaced apart posts may project from each disk for insertion onto aligned apertures of the reinforcement ring. Moreover, it is alternately envisioned that one or more posts can have a generally polygonal shape, a flat side surface or a greater width in one lateral direction than another (e.g., a rectangle or oval). These alternate post configurations deter rotation of the disks relative to the attached reinforcement ring and base pad during grinding. In the example shown, six such disks 51 are secured about the circumference of reinforcement ring 51 in an equally spaced apart manner. The posts may be solid or at least partially hollow. Different sizes, a different quantity, and/or differently grooved disks may alternately be used. Furthermore, the ring apertures 57 are preferably circular but may alternately have one or more flat edges, or even be elongated slots in the inner or outer edges 33 and 41, respectively, of ring 31.

Figure 4:
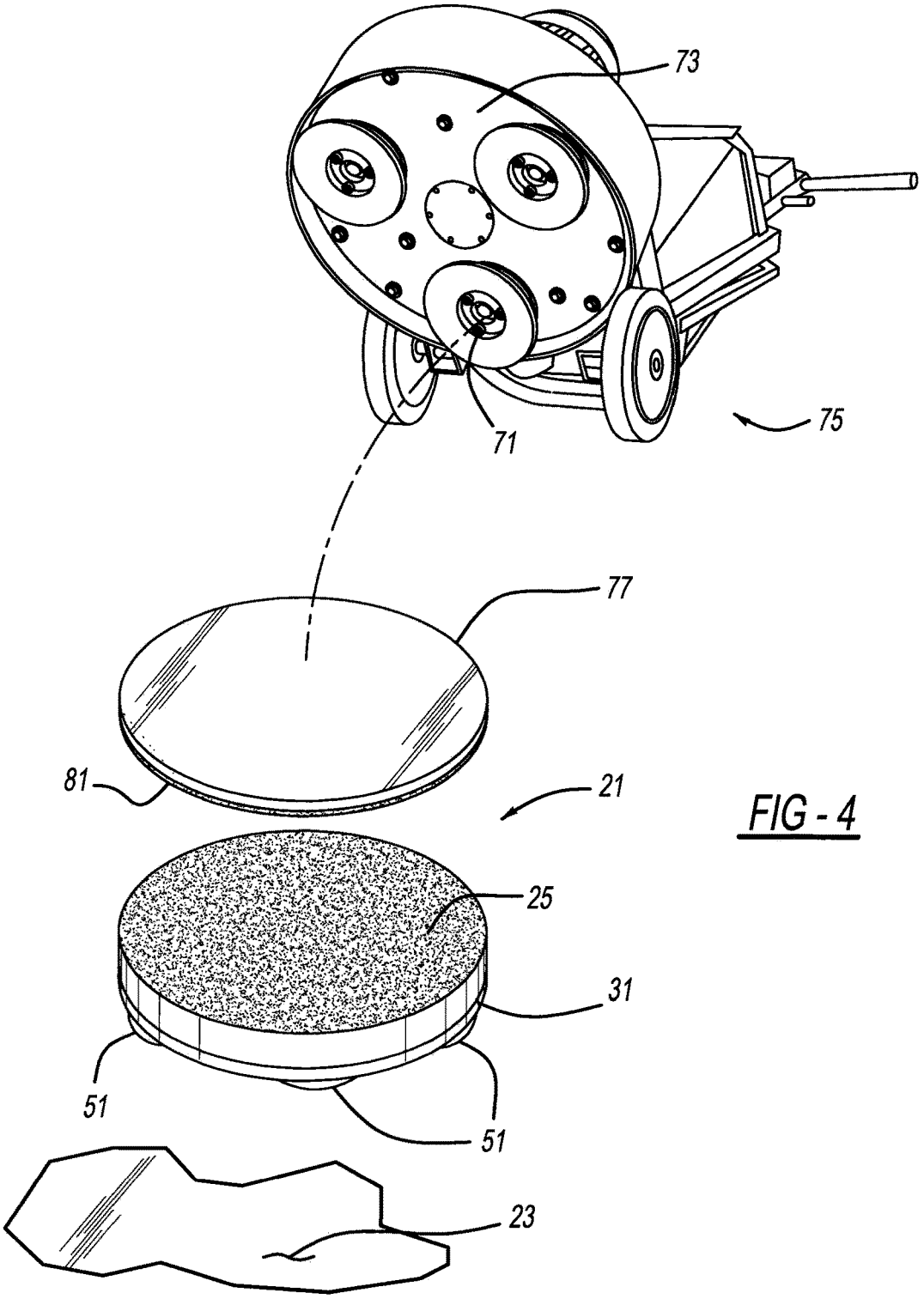
FIG. 4 is a partially exploded top perspective view showing the grinding pad apparatus including a powered grinding machine.
Figure 5:
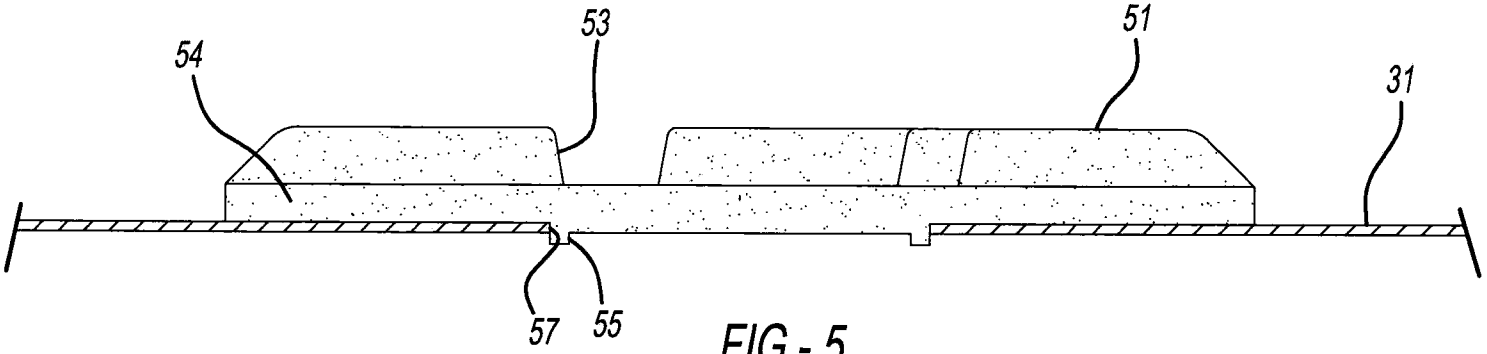
FIG. 5 is a cross-sectional view, taken along line 5-5 of FIG. 2, showing the grinding pad apparatus in a partially assembled condition.
Figure 6:
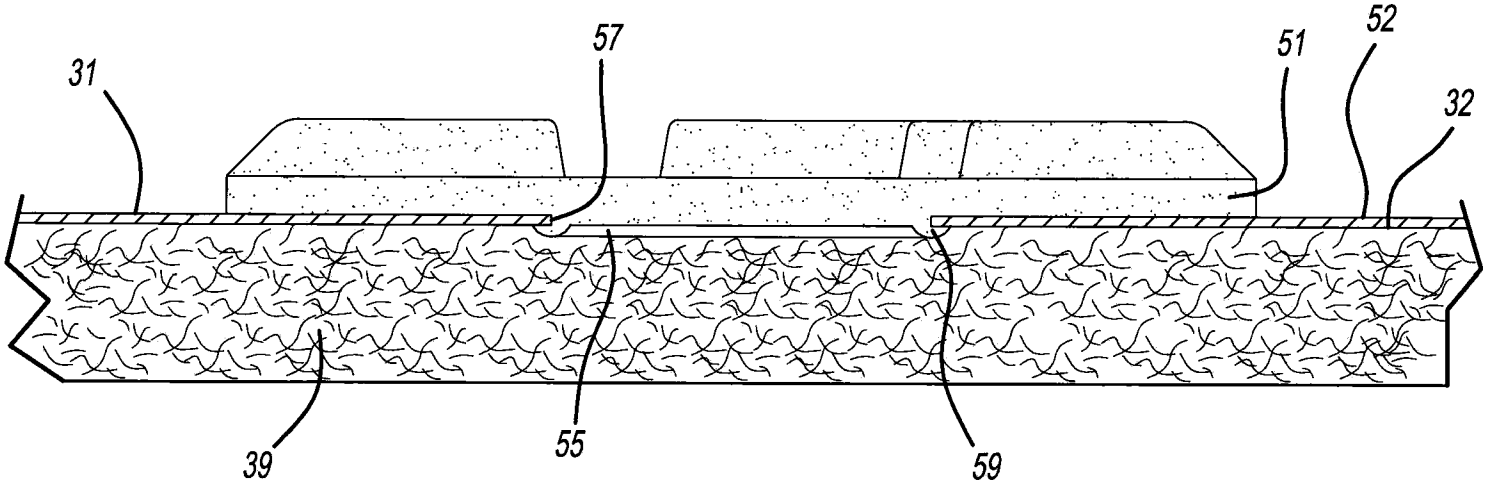
FIG. 6 is a cross-sectional view, taken along line 6-6 of FIG. 1, showing the grinding pad assembly in a fully assembled condition.

FIG. 4 shows one of multiple grinding pad apparatuses 21 secured to a rotatable flanged hub 71 of a larger counter-rotating rotor 73 of an electric motor-powered floor grinding machine 75. A hard rubber or polymeric disk 77 includes a plurality of clips or bolt-receiving holes for releasably securing disk 77 to hub 71. A layer 81 of hook-and-loop-type hooks (e.g. Velcro®) may be secured to the bottom of disk 77 and can be removably secured to fibrous base pad 25, however, it is also envisioned that pad 25 may be directly attached to hub 71 in some constructions. A plurality of the grinding pad apparatuses are secured for rotation about a central axis of rotor 73. Alternate powered machines and pad attachments may be used, such as those disclosed in the Background section hereinabove. Also, the present pad apparatus 21 may be attached to a walk-behind or riding power-trowel machine which may be propane fuel powered.

Figure 7:
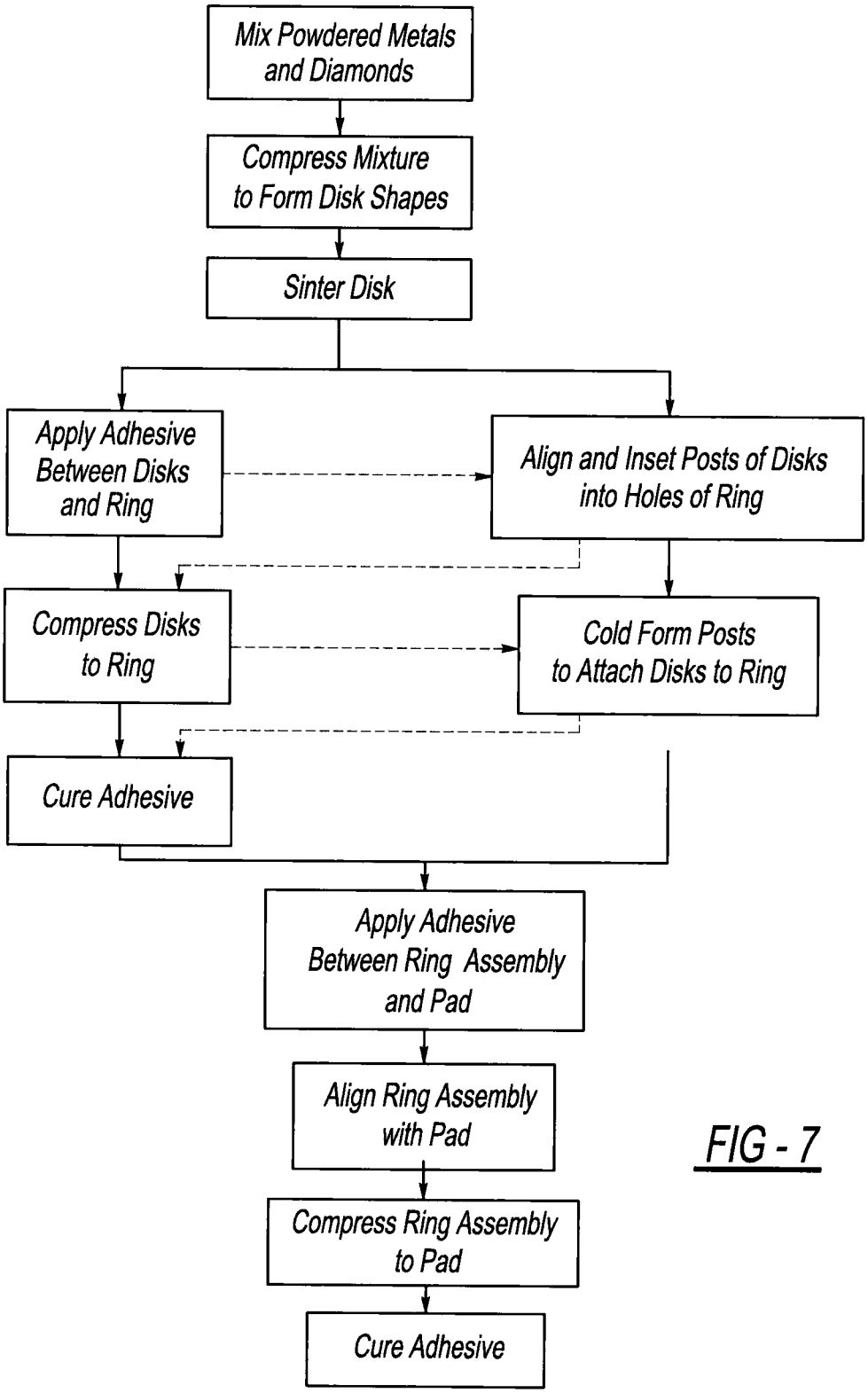
FIG. 7 is a flow chart showing a method of manufacturing the grinding pad apparatus.

Grinding pad apparatus 21 is manufactured as illustrated in FIG. 7. First, the powdered bronze, copper and iron are blended or mixed together in a vat along with the diamond particles. Second, the mixture is compressed within press to form the circular disk shape having a groove pattern on a bottom and the optional post on a top thereof. Third, this mixture is sintered or heated in an oven to about 700° C. Fourth, the spring steel reinforcement ring is stamped, cut or pierced to have its outer and inner circular edges, and its post-receiving apertures. Fifth, the adhesive is applied to one or both mating surfaces of the ring and disks. Sixth, if there are disk posts, then they are aligned with and inserted into their mating ring apertures. Seventh, the disks are compressed against the ring, and if the posts are present, then the heads are formed by cold forming or hammering. Eighth, the adhesive between the disks and ring cures in the compressed condition. Ninth, the ring assembly is aligned with the base pad. Tenth, adhesive is applied between the ring assembly and the base pad. Eleventh, the ring assembly is compressed to the base pad. And, finally, the adhesive between the ring assembly and the base pad is allowed to cure. It is preferred that the preceding steps are sequentially, or in some situations simultaneously, performed, however, the order of steps can be varied.

While various embodiments have been disclosed, it should be appreciated that additional variations of the pad assembly are also envisioned. For example, while preferred dimensions and metallic materials have been disclosed hereinabove, it should alternately be appreciated that other dimensions and metallic materials may be employed. Moreover, circular peripheral shapes for the pad, reinforcement ring and disks are preferred, however, other arcuate or even generally polygonal peripheral shapes may be used although certain of the present advantages may not be fully realized. Alternate base pads 25 may be used, such as foam-rubber, felt or other such flexible materials. It is also noteworthy that any of the preceding features may be interchanged and intermixed with any of the others. Furthermore, it is alternately feasible to have a differently shaped inner edge or even no central hole in the reinforcement ring or layer, although the torsional flexure may be inadequate for some uses, and there may be undesired extra material costs and weight with such. Accordingly, any and/or all of the dependent claims may depend from all of their preceding claims and may be combined together in any combination. Variations are not to be regarded as a departure from the present disclosure, and all such modifications are entitled to be included within the scope and sprit of the present invention.

The invention claimed is:

1. A pad apparatus comprising:

(a) a rotatable flexible pad including a floor-facing surface;

(b) a reinforcement layer attached to the floor-facing surface of the pad, the reinforcement layer including a flexible metallic material;

(c) abrasive grinding tools attached to a floor-facing surface of the reinforcement layer;

(d) the pad being thicker than a combined thickness of the reinforcement layer and a thickest one of the tools as viewed from a peripheral side of the pad;

(e) the floor-facing surface at a rotational centerline of the pad being exposed through a central opening in the reinforcement layer;

(f) the floor-facing surface of the pad being substantially flat; and (g) the tools covering only a minority of the floor-facing surface of the reinforcement layer.

2. The apparatus of claim 1, wherein each of the tools comprises a mechanical fastener projecting from a backside thereof, and each of the tools including a diamond material and a metallic material which are an integral single piece with the fastener.

3. The apparatus of claim 1, wherein each of the tools comprises a post extending through an associated aperture in the reinforcement layer, and a distal end of each of the posts is laterally expanded on an upper side of the reinforcement layer to mechanically attach the associated tool to the reinforcement layer, and the post includes at least one of: (a) a flat side, or (b) a greater width in one lateral direction than another lateral direction.

4. The apparatus of claim 1, wherein the reinforcement layer is an annular ring having circular inner and outer edges.

5. The apparatus of claim 1, wherein the flexible metallic material is spring steel, and the material of the pad includes fibers.

6. The apparatus of claim 5, wherein:

the material of the pad is free of diamond particles; and the metallic reinforcement layer provides radial stiffness and torsional flexibility such that one of the tools may move relative to another of the tools while there is grinding contact of all of the tools against the floor during rotation of the pad.

7. The apparatus of claim 1, wherein the tools are floor-contacting circular disks which include diamond particles with a grit size at or less than 100.

8. The apparatus of claim 1, wherein the tools are floor-contacting circular disks which include diamond particles and sintered powdered metal.

9. The apparatus of claim 1, wherein the material of the pad comprises foam but is free of diamond particles.

10. The apparatus of claim 1, further comprising:

at least a second flexible pad, at least a second metallic reinforcement layer attached to the second pad, and at least a second set of abrasive grinding tools attached to the second reinforcement layer;

an electrically or fuel powered riding machine adapted to simultaneously rotate the pads to grind a concrete, stone or terrazzo floor;

the reinforcement layers allowing flexure so that all of the tools can contact the floor even when uneven floor conditions are encountered; and the flexible metallic reinforcement layers each having a thickness no greater than 1 mm.

11. The apparatus of claim 1, wherein:

the peripheral surface of the pad is circular;

a peripheral surface of the reinforcement layer is substantially circular and has substantially a same diameter as that of the pad which are at least 7 inches; and a peripheral surface of all of the tools is substantially circular with a diameter of 1.5-2.5 inches.

12. The apparatus of claim 1, further comprising adhesive directly fastening the tools to the reinforcement layer and the reinforcement layer to fibers of the pad.

13. The apparatus of claim 12, further comprising mechanical fasteners coupled to a top surface of the center of the pad adapted for removable attachment of the pad to a rotating and walk-behind or riding floor polishing or grinding machine.

14. A pad apparatus comprising:

(a) a pad assembly comprising a flexible and fibrous pad;

(b) the pad assembly further comprising a reinforcement ring attached to the pad, the ring comprising spring steel;

(c) the pad assembly further comprising abrasive grinding tools attached to the ring, the tools comprising powdered metal and diamond particles;

(d) a walk-behind or riding powered machine including a rotatable hub adapted to rotate the pad to grind a concrete, stone or terrazzo floor;

(e) fasteners removably fastening the pad to the hub;

(f) the ring being adapted to torsionally flex for allowing all of the tools to contact against the floor even when uneven floor conditions are encountered;

(g) the ring including an opening through which a portion of the pad but not the hub is exposed;

(h) the tools covering only a minority of a floor-facing surface of the ring;

(i) an entire floor-facing surface of the pad being flat including at a central portion of the pad, and with fibrous material continuously extending across the entire floor-facing surface including at the central portion;

(j) the powered machine rotating multiple pad assemblies; and (k) the pad being thicker than a combined thickness of the reinforcement ring and one of the tools as viewed from a peripheral side of the pad.

15. The pad apparatus of claim 14, further comprising one single post projecting from a backside of each of the tools.

16. The apparatus of claim 15, wherein:

the post is integrally connected as a single piece with the associated tool;

the post assists in fastening the tool to the ring;

the single post centrally projects from the corresponding tool which is a circular disk; and a hollow area is located within a middle of an outwardly enlargeable head of the post.

17. The apparatus of claim 14, wherein:

the diamond particles are intermixed with the powdered metal of the tools.

18. The apparatus of claim 14, wherein:

each of the tools are disks which include multiple radially extending grooves on a floor-abrading surface thereof;

each of the disks has a circular periphery;

there are at least six of the disks attached to the ring; and the grooves have a depth deeper than a thickness of the ring.

19. The apparatus of claim 14, wherein:

the ring has a circular periphery concentric with a circular periphery of the pad; and the fasteners removably fasten the central portion of the pad to the hub.

20. The apparatus of claim 14, wherein the pad includes fibers but is free of diamond particles.

21. The apparatus of claim 19, further comprising adhesive directly fastening the tools to the reinforcement ring and the reinforcement ring to fibers of the pad.

* * * * *